US011213106B2

(12) United States Patent
Tsai

(10) Patent No.: US 11,213,106 B2
(45) Date of Patent: Jan. 4, 2022

(54) WOVEN ELASTIC BAND

(71) Applicant: Chung-Shun Tsai, Changhua (TW)

(72) Inventor: Chung-Shun Tsai, Changhua (TW)

( * ) Notice: Subject to any disclaimer, the term of this patent is extended or adjusted under 35 U.S.C. 154(b) by 252 days.

(21) Appl. No.: 15/909,913

(22) Filed: Mar. 1, 2018

(65) Prior Publication Data

US 2019/0269218 A1 Sep. 5, 2019

(51) Int. Cl.
*A45D 8/36* (2006.01)
*A45D 8/00* (2006.01)

(52) U.S. Cl.
CPC ..... *A45D 8/36* (2013.01); *A45D 8/004* (2021.01)

(58) Field of Classification Search
CPC ... A45D 8/36; A45D 8/00; A45D 8/34; A45D 2008/002; A45D 2008/004; A45D 2008/006; A45D 2008/008; A45D 2008/345; Y10T 24/3726; D03D 1/00; D03D 1/005; D03D 3/005; D03D 7/00; D03D 11/00; D03D 11/02; D03D 13/004; D03D 13/008; D03D 17/00; D03D 23/00
USPC ..... 132/212, 273, 275; 2/174, 244; 87/11
See application file for complete search history.

(56) References Cited

U.S. PATENT DOCUMENTS

| | | | | |
|---|---|---|---|---|
| 6,076,532 | A * | 6/2000 | Thomas | A45D 8/34 132/273 |
| 6,182,672 | B1 * | 2/2001 | Abasta-Douglas | A45D 8/00 132/273 |
| D509,320 | S * | 9/2005 | Shefsky | D28/39 |
| 2005/0109361 | A1 * | 5/2005 | Klug | A45D 8/34 132/275 |
| 2013/0014351 | A1 * | 1/2013 | Kuglen | B65D 63/1027 24/17 B |
| 2016/0262503 | A1 * | 9/2016 | Rizzuto | A45D 8/34 |
| 2017/0181509 | A1 * | 6/2017 | Ingimundarson | A44C 5/12 |

* cited by examiner

*Primary Examiner* — Rachel R Steitz
*Assistant Examiner* — Karim Asqiriba
(74) *Attorney, Agent, or Firm* — Alan D. Kamrath; Karin L. Williams; Mayer & Williams PC

(57) ABSTRACT

A woven elastic band includes a main body woven from an inner elastic band, at least an outer woven layer and at least two symmetric elastic strips by a horn gear braiding machine which works by a circular braiding process. The outer woven layer is configured to be woven together with the two elastic strips to cover the inner elastic band, and through a weaving process, a plurality of small diameter sections and a plurality of large diameter sections are alternatively formed on the main body. Each of the elastic strips has an elastic protruding portion formed on an outer periphery thereof. The protruding portions improve the resilience of the main body and the frictions at the large diameter sections of the main body so as to prevent a bead coupled around the small diameter sections of the main body from sliding or detaching from the main body.

4 Claims, 11 Drawing Sheets

WOVEN ELASTIC BAND

FIELD OF THE INVENTION

The present invention relates to an elastic band and more particularly to a woven elastic band.

BACKGROUND OF THE INVENTION

Referring to FIGS. 11 and 12, a conventional elastic band (20) comprises a plurality of stretchable or horn-shaped blocking sections (21). The elastic band (20) is used cooperating with a bead (22), and when the elastic band (20) is stretched, each of outer diameters of the blocking sections (21) is configured to become smaller, which enables the bead (22) to pass therethrough. On the other hand, when the elastic band (20) is released from external force, the blocking sections (21) of the elastic band (20) is configured to back to initial outer diameters thereby blocking the bead (22) therebetween. The bead (22) coupled between blocking sections (21) can form the elastic band (20) into a circle or form a portion of the elastic band (20) into a circle so as to enable the elastic band (20) to be used as a hair band or other bands.

However, the conventional elastic band is disadvantageous because: the bead (22) usually cannot be secured by the blocking sections (21) and is prone to slide aside after a period of time, which leads to the elastic band (20) losing its function. Therefore, there remains a need for a new and improved design for a woven elastic band to overcome the problems presented above.

SUMMARY OF THE INVENTION

The present invention provides a woven elastic band which includes a main body woven from an inner elastic band, at least an outer woven layer and at least two symmetric elastic strips by a horn gear braiding machine which works by a circular braiding process. The outer woven layer is configured to be woven together with the two elastic strips to cover the inner elastic band, and through weaving process, a plurality of small diameter sections and a plurality of large diameter sections are alternatively formed on the main body. Furthermore, each of the elastic strips has an elastic protruding portion formed on an outer periphery thereof, and the elastic protruding portion has large diameters and small diameters alternatively at positions corresponding to the large diameter sections and the small diameter sections of the main body. Additionally, the two elastic protruding portions on the two elastic strips are arranged symmetrically.

In one embodiment, the main body comprises four elastic strips.

In another embodiment, the main body has two outer woven layers formed in a double-layer structure.

In still another embodiment, the main body has two outer woven layers formed in a double-layer structure, and each of the two outer woven layers is cooperatively woven with two elastic strips; the two outer woven layers are formed in different colors, which enables the main body to have an appearance of interlaced colors.

Comparing Compared with conventional elastic band, the present invention is advantageous because: the main body comprises at least two elastic strips having the elastic protruding portions, which improves the resilience of the main body and the frictions at the large diameter sections of the main body so as to prevent the bead coupled around the small diameter sections of the main body from sliding or detaching from the main body.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
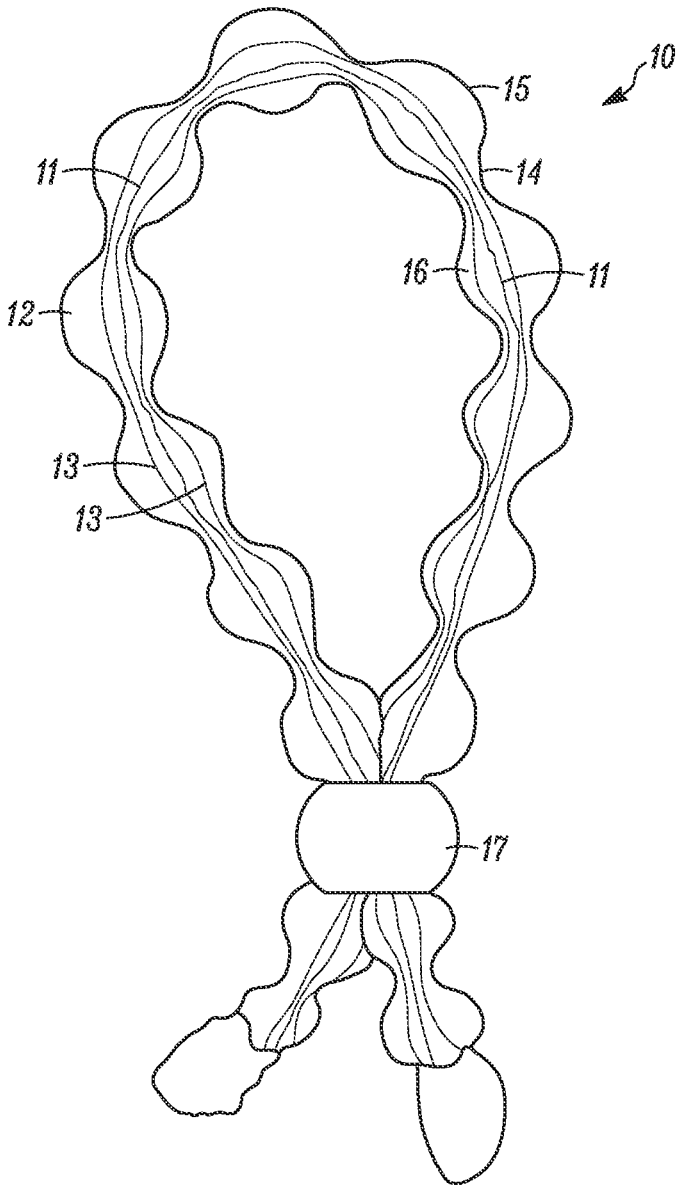
FIG. 1 is a front view of a woven elastic band of the present invention.
Figure 2:
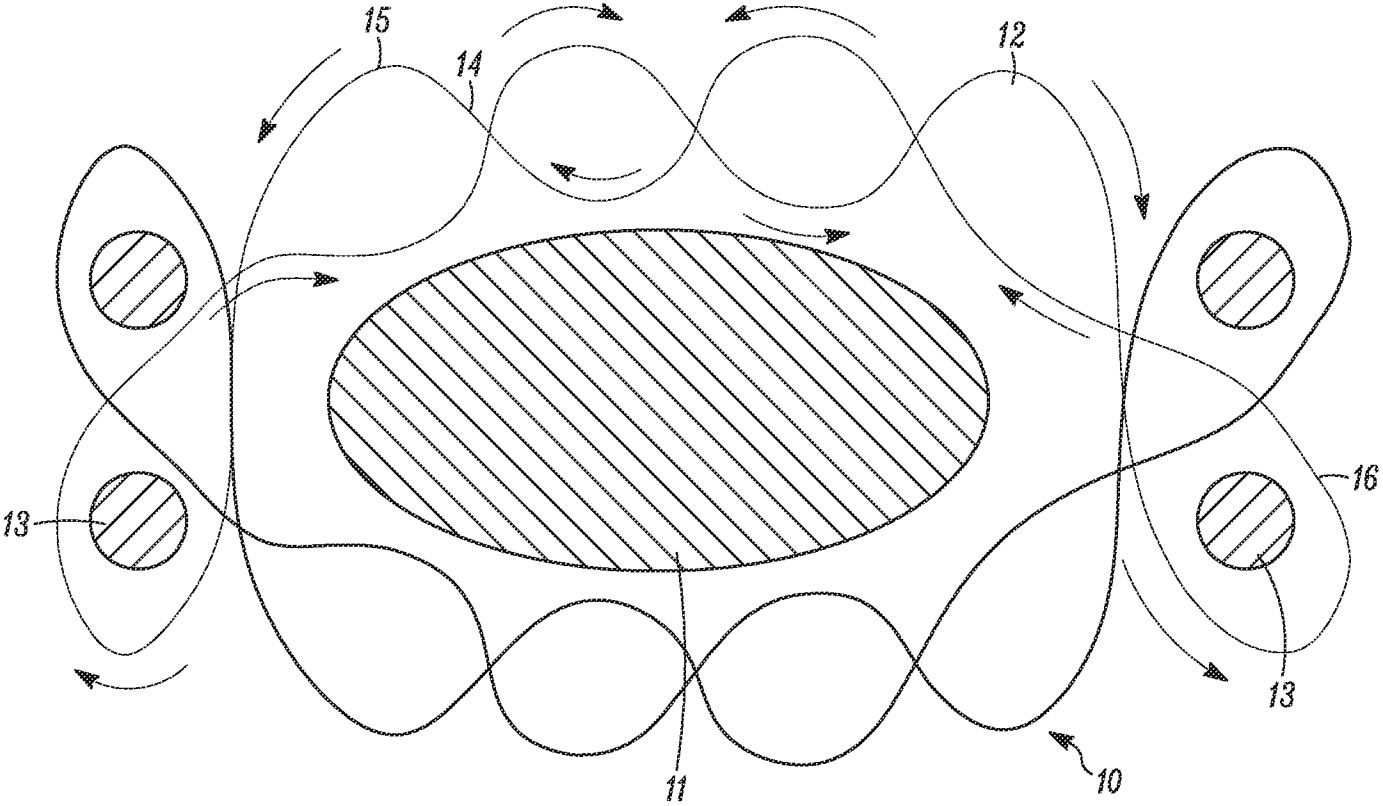
FIG. 2 is a sectional schematic view along a-a of FIG. 1 illustrating the weaving process of the woven elastic band in the present invention.
Figure 3:
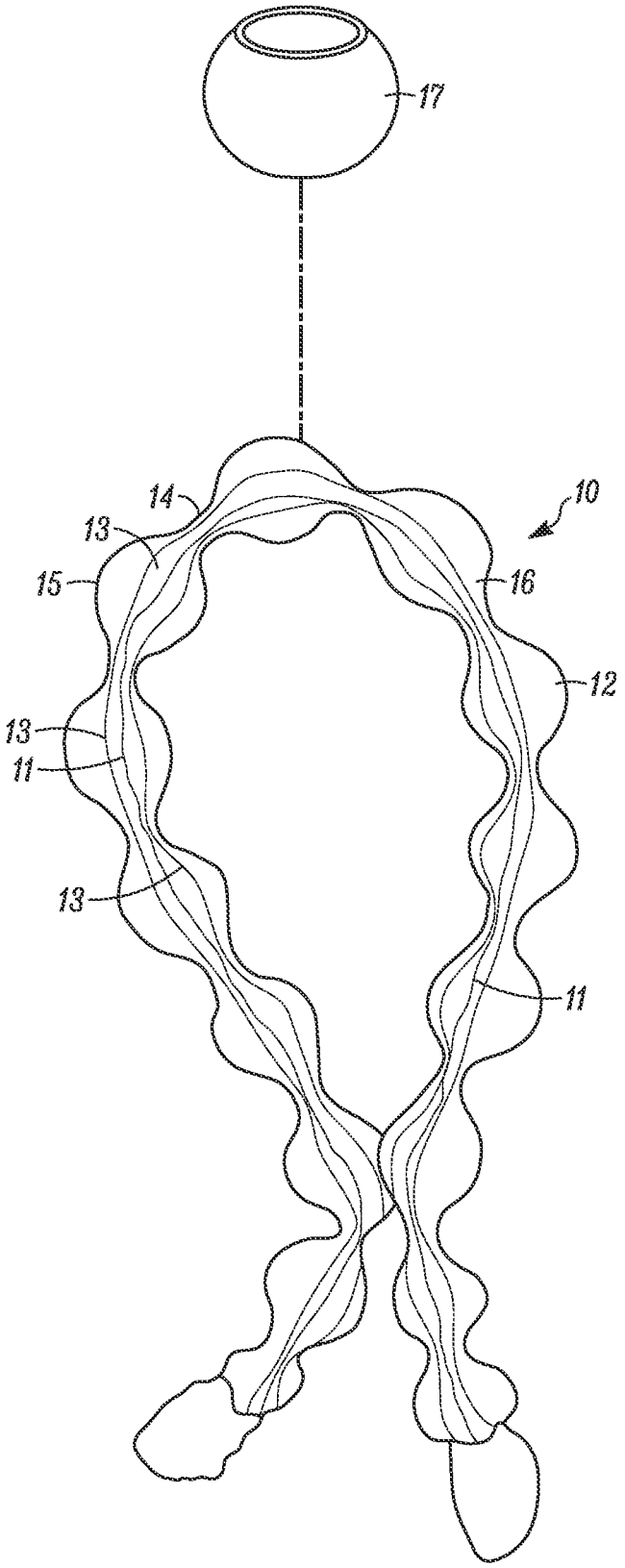
FIG. 3 is an exploded view of the woven elastic band of the present invention.
Figure 4:
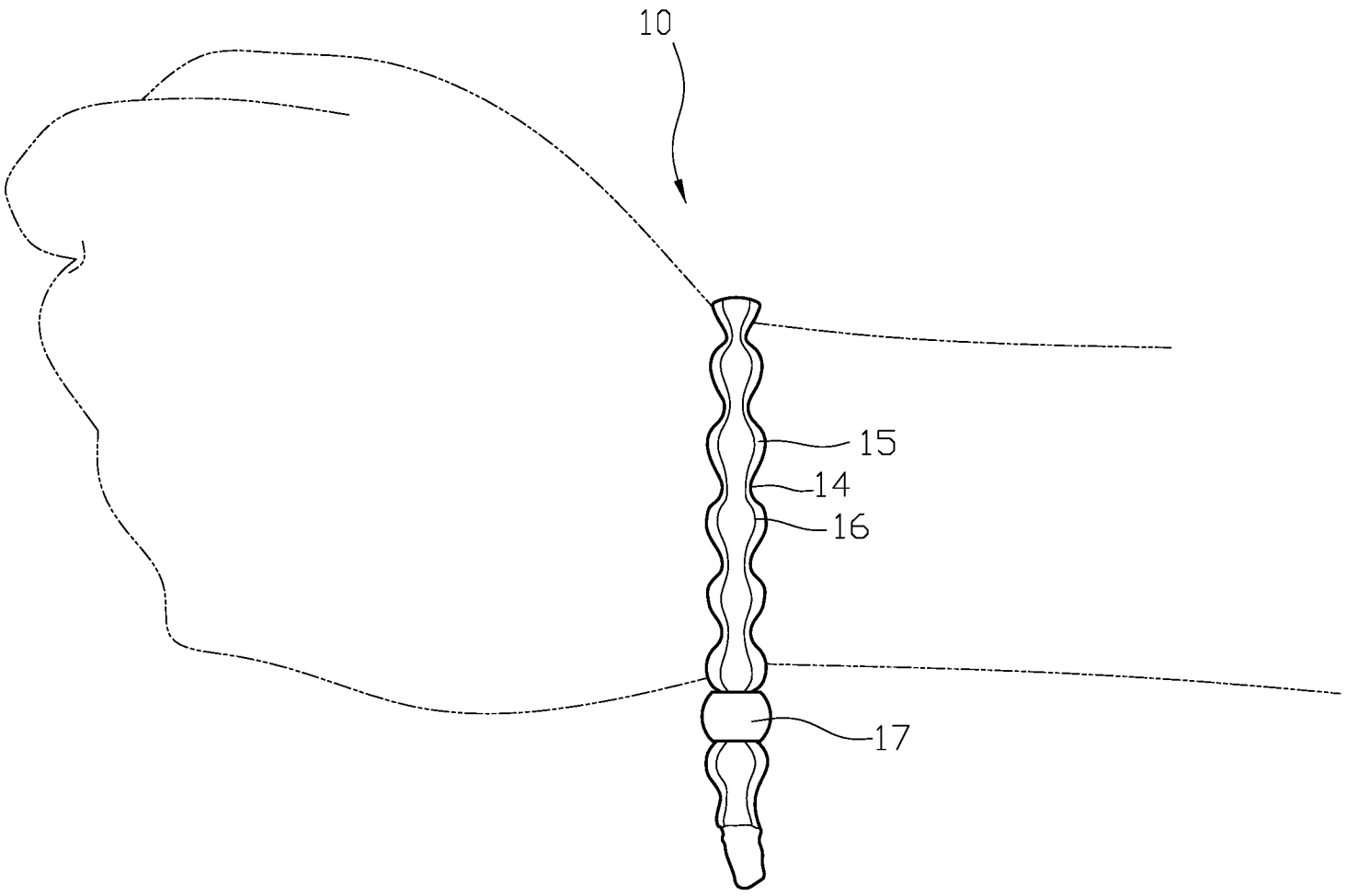
FIG. 4 is a schematic view illustrating the woven elastic band of the present invention worn on the wrist of a user.
Figure 5:
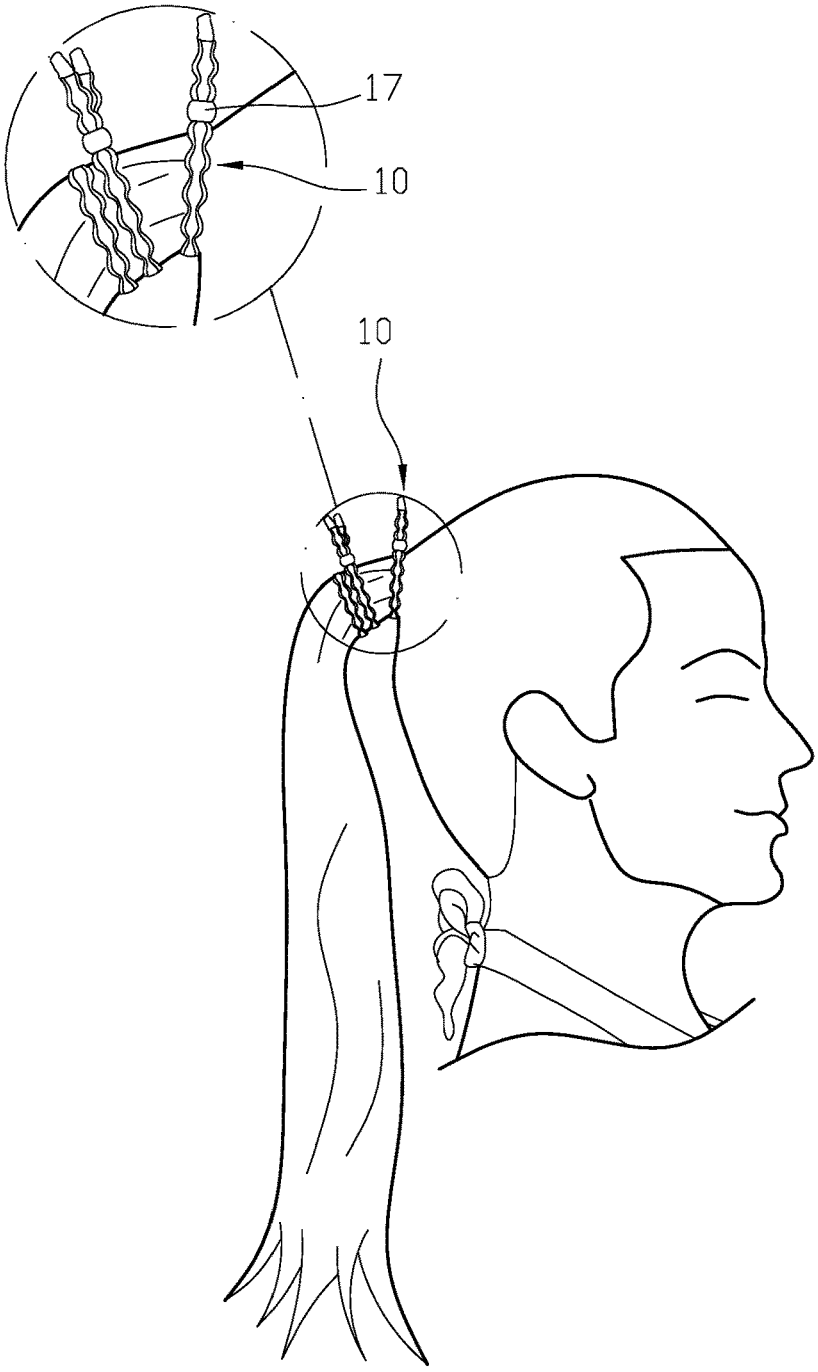
FIG. 5 is a schematic view illustrating the woven elastic band of the present invention used as a hairband.
Figure 6:
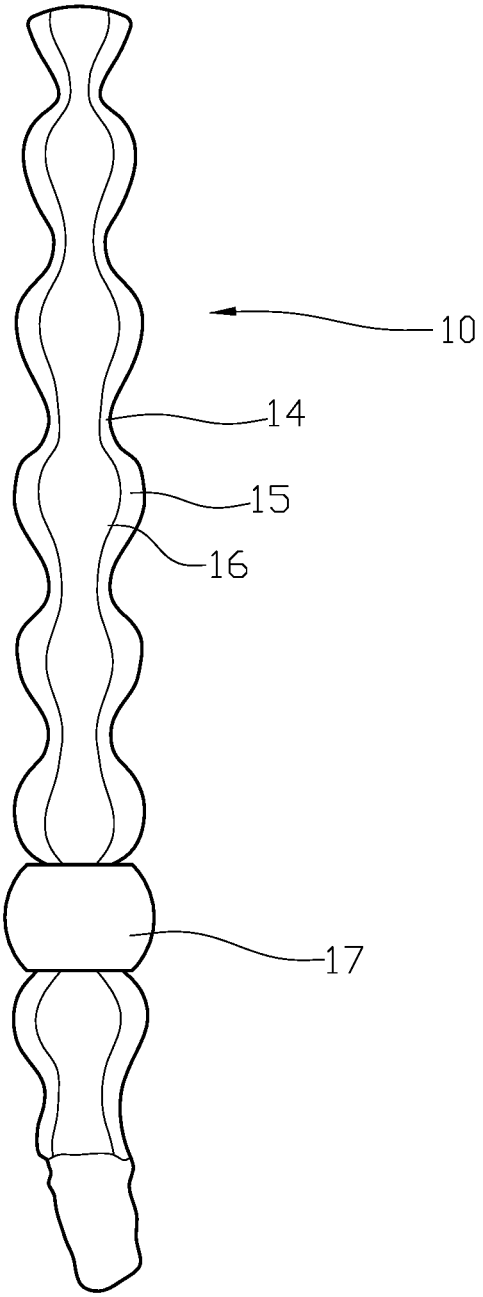
FIG. 6 is a schematic view illustrating a bead tightly coupled between adjacent large diameter sections of a main body of the woven elastic band in the present invention.

In order to further understand the goal, characteristics and effect of the present invention, a number of embodiments along with the drawings are illustrated as following:

Referring to FIGS. 1 and 2, the present invention provides a woven elastic band which comprises a main body (10) woven from an inner elastic band (11), at least an outer woven layer (12) and at least two symmetric elastic strips (13) by a horn gear braiding machine which works by a circular braiding process. The outer woven layer (12) is configured to be woven together with the two elastic strips (13) to cover the inner elastic band (11), and through different tightness of weaving, a plurality of small diameter sections (14) and a plurality of large diameter sections (15) are alternatively formed on the main body (10). Furthermore, each of the elastic strips (13) has an elastic protruding portion (16) formed on an outer periphery thereof, and the elastic protruding portion (16) has large diameters and small diameters alternatively at positions corresponding to the large diameter sections (15) and the small diameter sections (14) of the main body (10). Additionally, the two elastic protruding portions (16) on the two elastic strips (13) are arranged symmetrically.

In one embodiment, the main body (10) has two outer woven layers (12) woven with four elastic strips (13) by a horn gear braiding machine to cover one inner elastic band therein, wherein the two outer woven layers (12) are formed in a double-layer structure, and each of the two outer woven layers (12) is cooperatively woven with two symmetric elastic strips (13) such that the four elastic protruding portions (16) on the four elastic strips (13) are arranged symmetrically at positions corresponding to the large diameter sections (15) and the small diameter sections (14) of the main body (10). In one embodiment, the two outer woven layers (12) are formed in different colors, which enables the main body (10) to have an appearance of interlaced colors.

Figure 7:
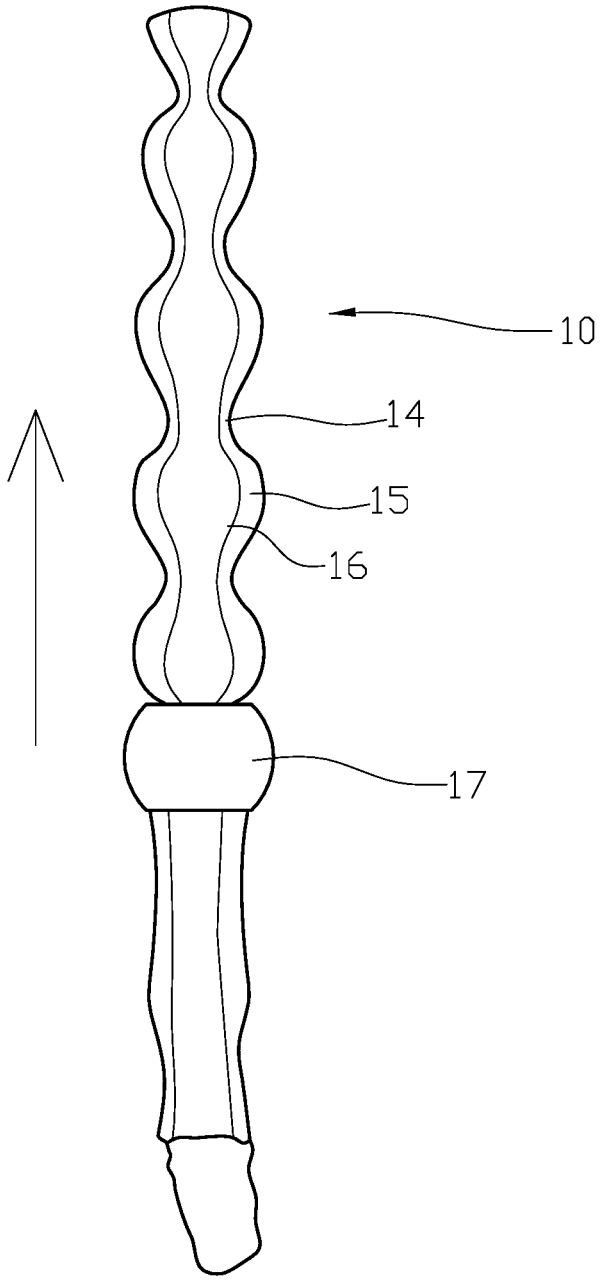
FIG. 7 is a schematic view illustrating the bead is configured to move through the large diameter sections of the main body of the woven elastic band when external force stretches the main body.

Referring to FIGS. 3 to 6, the main body (10) is used cooperating with a bead (17), and two ends of the main body (10) are configured to simultaneously penetrate through and couple with the bead (17) to form the main body (10) into a circle or form a portion of the main body (10) into a circle. With external force to stretch the main body (10), the bead (17) is adapted to move through the large diameter sections (15) to adjust a diameter of the formed circle. When the external force is released, the bead (17) is configured to be tightly coupled around two parallel small diameter sections (14), and the position of the bead (17) is limited by adjacent large diameter sections (15) such that the main body (10) can be used as a hairband or achieve other binding purposes (as shown in FIG. 7).

Figure 8:
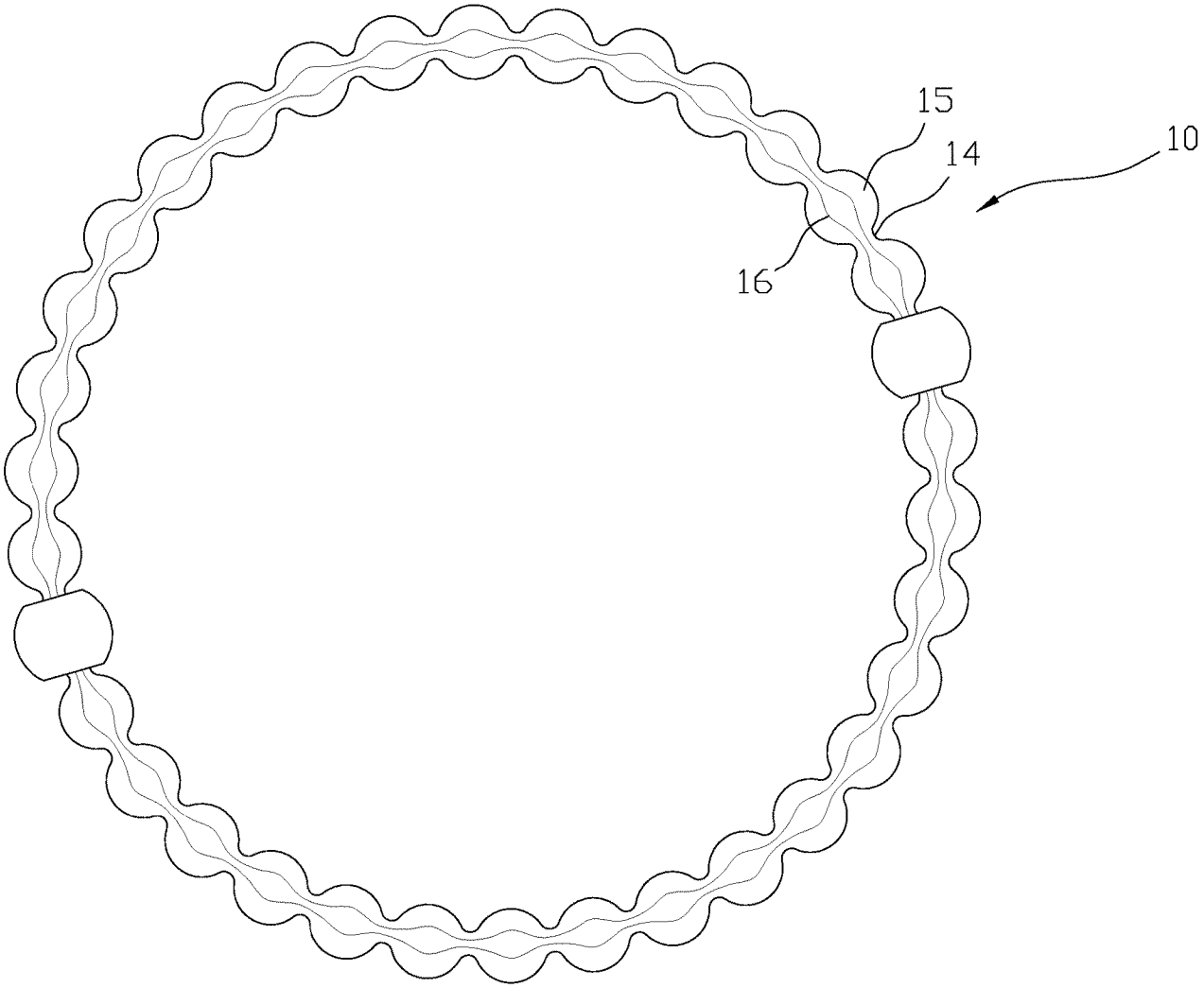
FIG. 8 is a schematic view of another embodiment of the woven elastic band of the present invention.
Figure 9:
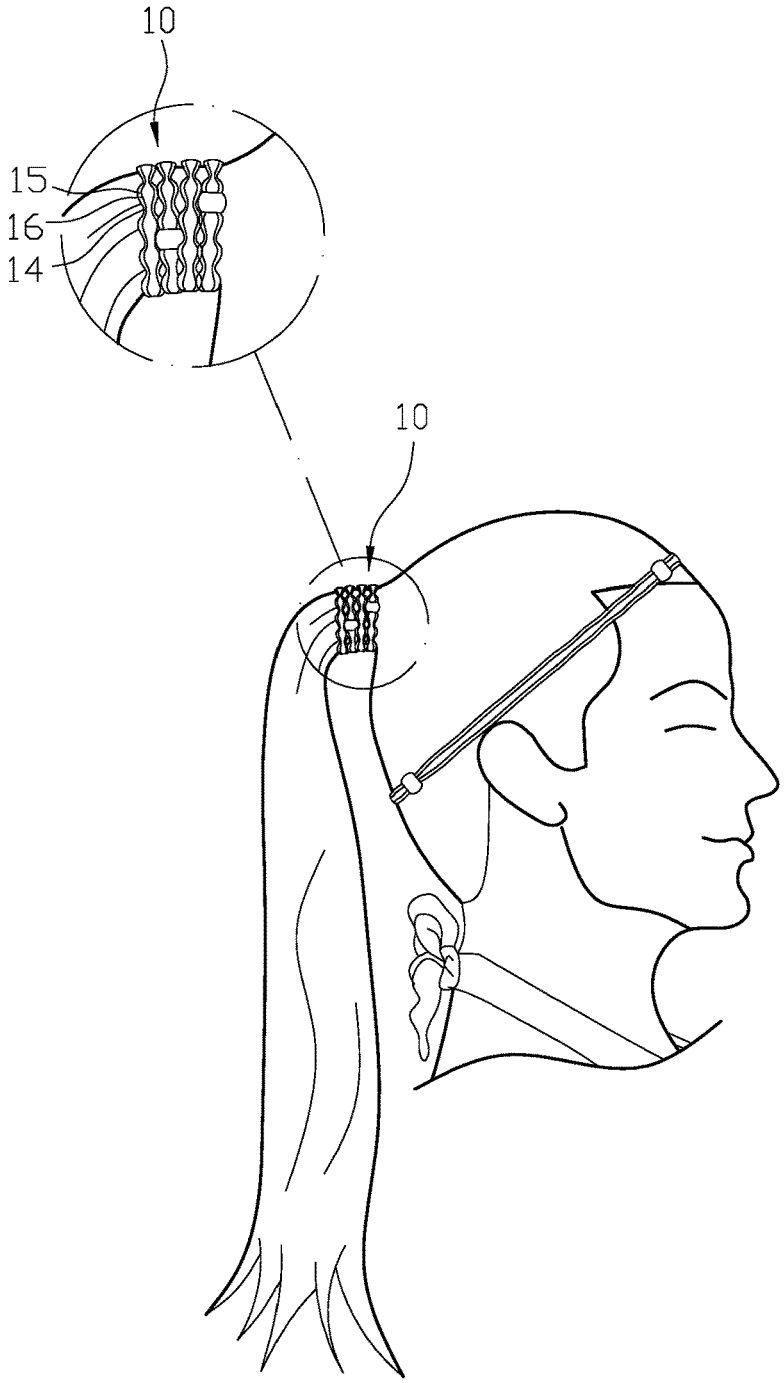
FIG. 9 is a schematic view illustrating another embodiment of the woven elastic band used as a hairband.
Figure 10:
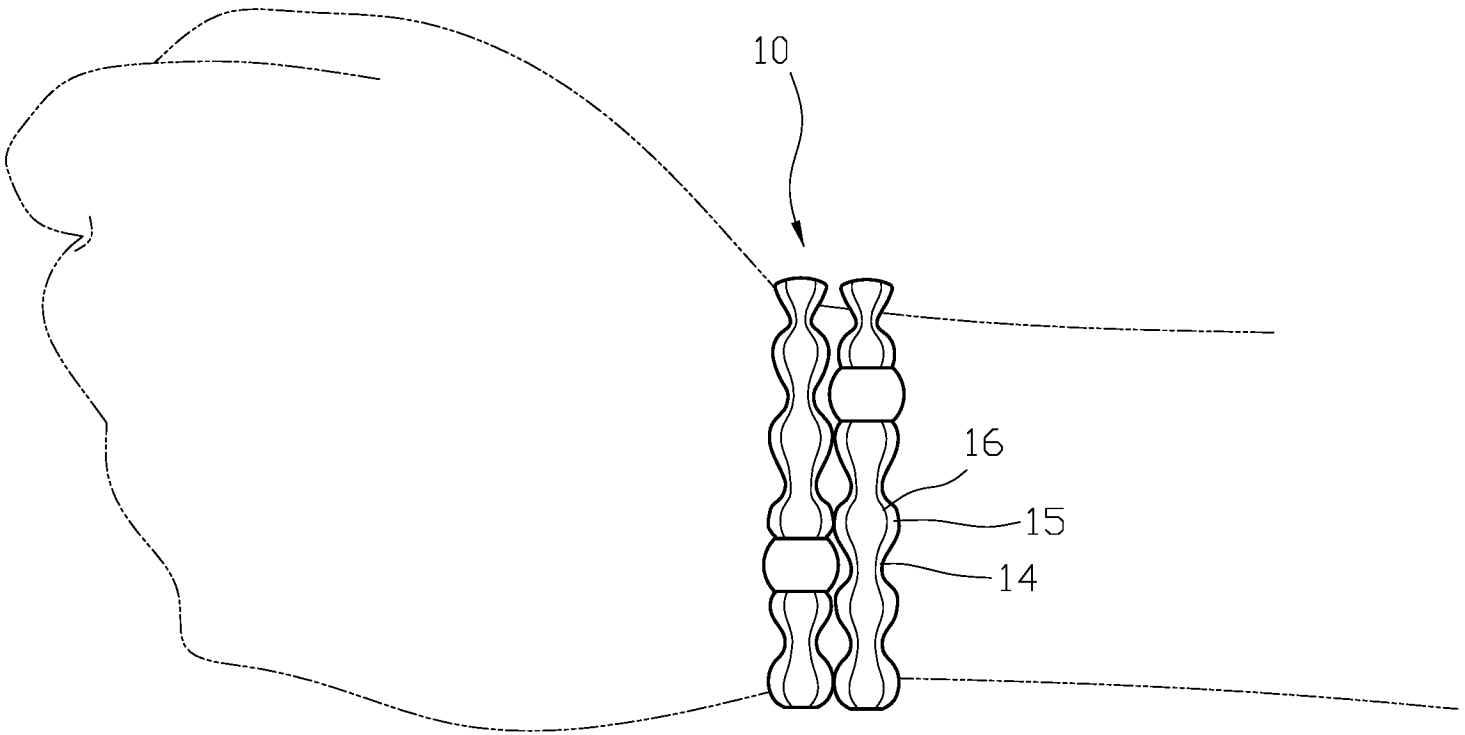
FIG. 10 is a schematic view illustrating another embodiment of the woven elastic band worn on the wrist of a user.
Figure 11:
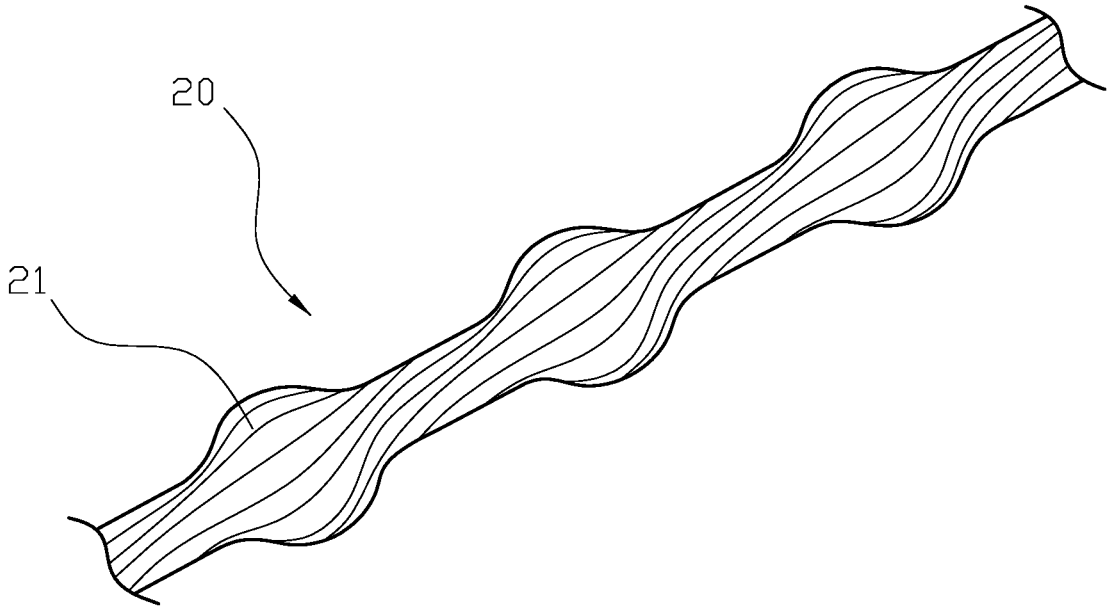
FIG. 11 PRIOR ART
FIG. 11 is a prior art elastic band.
Figure 12:
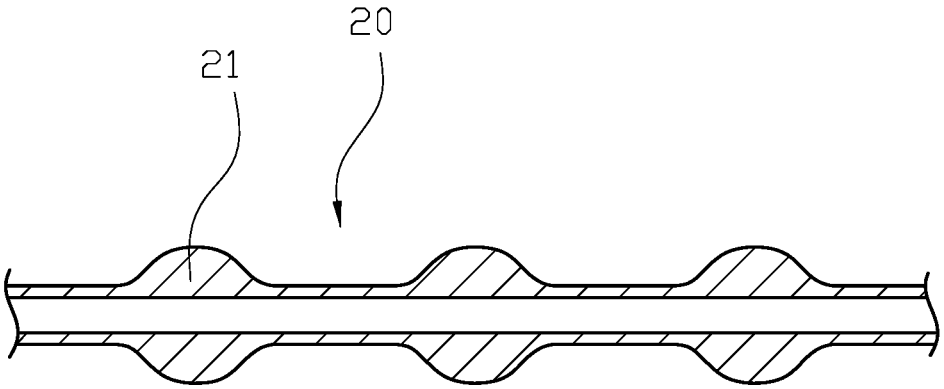
FIG. 12 PRIOR ART
FIG. 12 is a prior art elastic band.

In another embodiment, referring to FIGS. 8 to 10, the elastic main body (10) is formed in a ring shape which can be directly used as a hairband or to be worn on the wrist of a user when not used.

Compared with a conventional elastic band, the present invention is advantageous because: the main body (10) includes at least two elastic strips (13) having the elastic protruding portions (16), which improves the resilience of the main body (10) and the frictions at the large diameter sections (15) of the main body (10) so as to prevent the bead (17) coupled around the small diameter sections (14) of the main body (10) from sliding or detaching from the main body (10).

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A woven elastic band comprising:

a main body woven having an inner elastic band, an outer woven layer and at least two symmetric elastic strips located inside the outer woven layer to cover the inner elastic band, the main body having alternating small diameter sections and large diameter sections, wherein the outer woven layer is woven together with the at least two symmetric elastic strips to cover the inner elastic band, and a plurality of small diameter sections and a plurality of large diameter sections are alternatively formed on the main body;

wherein each of the at least two symmetric elastic strips has an elastic protruding portion formed on an outer periphery thereof, and the elastic protruding portion comprises large diameters and small diameters alternatively at positions corresponding to the large diameter sections and the small diameter sections of the main body; and wherein the two elastic protruding portions on the at least two elastic strips are arranged symmetrically.

2. The woven elastic band of claim 1, wherein the main body comprises four elastic strips.

3. The woven elastic band of claim 1, wherein the main body has two outer woven layers formed in a double-layer structure.

4. The woven elastic band of claim 3, wherein each of the two outer woven layers is cooperatively woven with two elastic strips, and the two outer woven layers are formed in different colors such that the main body has an appearance of interlaced colors.

* * * * *